US008209094B2

(12) United States Patent
Lin et al.

(10) Patent No.: US 8,209,094 B2
(45) Date of Patent: Jun. 26, 2012

(54) HYDRAULIC IMPLEMENT SYSTEM HAVING BOOM PRIORITY

(75) Inventors: Hong-Chin Lin, Glenview, IL (US); Venkata Rama Varma Dantuluri, Champaign, IL (US)

(73) Assignee: Caterpillar Inc., Peoria, IL (US)

( * ) Notice: Subject to any disclaimer, the term of this patent is extended or adjusted under 35 U.S.C. 154(b) by 1008 days.

(21) Appl. No.: 12/010,259

(22) Filed: Jan. 23, 2008

(65) Prior Publication Data

US 2009/0185888 A1 Jul. 23, 2009

(51) Int. Cl.
*G06F 19/00* (2011.01)

(52) U.S. Cl. ..... 701/50; 701/63; 60/420; 60/422; 60/431; 60/452; 60/459; 180/305; 180/307

(58) Field of Classification Search ..... 701/1, 50; 60/421, 422; 180/305, 306, 307
See application file for complete search history.

(56) References Cited

U.S. PATENT DOCUMENTS

| | | | | | |
|---|---|---|---|---|---|
| 3,749,269 | A | | 7/1973 | Conrad | |
| 3,796,336 | A | | 3/1974 | Ratliff | |
| 4,015,482 | A | | 4/1977 | Ito et al. | |
| 4,479,349 | A | * | 10/1984 | Westveer | 60/420 |
| 4,776,751 | A | | 10/1988 | Saele | |
| 4,984,956 | A | * | 1/1991 | Ikari et al. | 414/699 |
| 5,152,143 | A | * | 10/1992 | Kajita et al. | 60/420 |
| 5,214,916 | A | * | 6/1993 | Lukich | 60/431 |
| 5,320,025 | A | * | 6/1994 | Ikari | 91/459 |
| 5,493,798 | A | * | 2/1996 | Rocke et al. | 37/348 |
| 5,678,470 | A | | 10/1997 | Koehler et al. | |
| 5,873,244 | A | | 2/1999 | Cobo et al. | |
| 6,047,228 | A | * | 4/2000 | Stone et al. | 701/50 |
| 6,185,493 | B1 | | 2/2001 | Skinner et al. | |
| 6,371,214 | B1 | | 4/2002 | Anwar et al. | |
| 6,498,973 | B2 | | 12/2002 | Dix et al. | |
| 6,546,325 | B1 | | 4/2003 | Kubota et al. | |
| 6,609,369 | B2 | * | 8/2003 | Koehler et al. | 60/459 |
| 6,618,659 | B1 | * | 9/2003 | Berger et al. | 701/50 |
| 7,142,967 | B2 | | 11/2006 | Brandt et al. | |
| 7,555,855 | B2 | * | 7/2009 | Alshaer et al. | 37/382 |
| 7,779,628 | B2 | * | 8/2010 | Petre | 60/413 |
| 2002/0070071 | A1 | | 6/2002 | Schuh | |
| 2003/0149518 | A1 | | 8/2003 | Brandt et al. | |
| 2004/0117092 | A1 | * | 6/2004 | Budde | 701/50 |
| 2005/0216105 | A1 | * | 9/2005 | Tabor | 700/63 |
| 2005/0278100 | A1 | | 12/2005 | Porter | |
| 2006/0090459 | A1 | * | 5/2006 | Devier et al. | 60/422 |
| 2006/0191732 | A1 | * | 8/2006 | Lunzman et al. | 180/307 |
| 2006/0229787 | A1 | | 10/2006 | Kurup et al. | |
| 2006/0245896 | A1 | * | 11/2006 | Alshaer et al. | 414/685 |
| 2007/0044464 | A1 | * | 3/2007 | Verkuilen | 60/422 |
| 2008/0034746 | A1 | * | 2/2008 | Verkuilen | 60/422 |
| 2008/0245064 | A1 | * | 10/2008 | Livraghi | 60/422 |
| 2009/0071144 | A1 | * | 3/2009 | Ma et al. | 60/452 |

* cited by examiner

*Primary Examiner* — Khoi Tran
*Assistant Examiner* — Jonathan L Sample

(57) ABSTRACT

A hydraulic implement system for a machine is disclosed. The hydraulic implement system may have a boom member, a boom actuator, and a boom operator control device movable to indicate a related operator desired boom member velocity. The hydraulic implement system may also have an implement pivotally connected to the boom member, an implement actuator, and an implement operator control device movable to indicated a related operator desired implement velocity. The range of the implement operator control device may be divided into a first portion and a second portion. The hydraulic implement system may also have a controller configured to selectively limit a velocity of the implement during manipulation of the implement operator control device within the first portion such that a lift velocity of the boom member of at least 65% of the desired boom member velocity is always possible.

19 Claims, 4 Drawing Sheets

HYDRAULIC IMPLEMENT SYSTEM HAVING BOOM PRIORITY

TECHNICAL FIELD

The present disclosure relates generally to a hydraulic implement system and, more particularly, to a hydraulic implement system having boom priority.

BACKGROUND

Machines such as, for example, loaders, excavators, and other types of heavy equipment use multiple actuators supplied with pressurized fluid from a pump on the machine to accomplish a variety of tasks. These actuators are typically speed controlled based on an actuation position of an operator control device. For example, an operator control device such as a joystick, a pedal, or other suitable device may be movable to generate a signal indicative of a desired speed of an associated hydraulic actuator. When an operator moves the interface device, the operator expects the hydraulic actuator to move at a related speed. However, when multiple actuators are simultaneously operated, the hydraulic fluid flow from a common pump may be insufficient to move all of the actuators at their desired speeds. In these situations, the majority of the pressurized fluid from the pump flows to the actuator(s) having the least resistance, resulting in the remaining actuator (s) receiving insufficient fluid. When an actuator receives less fluid than demanded, it may move at a slower than desired speed or even stop moving completely.

One system attempting to minimize the likelihood of an actuator receiving insufficient fluid is described in U.S. Pat. No. 6,618,659 (the '659 patent) issued to Berger et al. on Sep. 9, 2003. The '659 patent describes a skid-steer loader having a first hydraulic sub-circuit associated with a boom arm, and a second hydraulic sub-circuit associated with a bucket, which is pivotally connected to an end of the boom arm. The first sub-circuit includes a boom cylinder connected to move the boom arm, and an associated electro-hydraulic boom valve that activates extension and retraction of the boom cylinder. The second sub-circuit includes an implement cylinder connected to move the bucket, and an associated electro-hydraulic implement valve that activates extension and retraction of the implement cylinder. The boom and implement valves are connected in parallel to receive a combined flow of pressurized fluid from a low flow gear pump and from a high flow gear pump. A controller is configured to receive a first input signal from a boom manual control sensor, and a second input signal from an implement manual control sensor. The controller sends a first control signal to activate the boom valve in response to receiving the first input signal, and sends a second control signal to activate the implement valve in response to receiving the second input signal. The controller is programmed to modify the second control signal in accordance with a table-based duty factor when the boom arm is lifted and the bucket is dumped simultaneously. The modified signal reduces and thereby slows down the flow of hydraulic fluid through the implement sub-circuit. As a result, more fluid is available from the low and high flow gear pumps for boom arm lift during bucket dumping than otherwise would have been available.

Although the skid-steer loader of the '659 patent may benefit from improved boom lift during a bucket dumping event, the benefit and applicability thereof may be limited. That is, although perhaps suitable for a small skid-steer type loader, the table-based duty factors described above may function poorly with another type or size of machine. In addition, the use of multiple pumps may result in complex flow control and unpredictable instabilities. Further, the use of fixed displacement gear type pumps may limit modulation of the pressurized fluid supply.

The disclosed hydraulic implement system is directed to overcoming one or more of the problems set forth above.

SUMMARY OF THE INVENTION

In one aspect, the present disclosure is directed to a hydraulic implement system. The hydraulic implement system may include a boom member, a boom actuator situated to move the boom member, and a boom operator control device movable through a range to indicate a related operator desired boom member velocity and to affect a corresponding motion of the boom actuator. The hydraulic implement system may also include an implement pivotally connected to the boom member, an implement actuator situated to move the implement relative to the boom member, and an implement operator control device movable through a range to indicate a related operator desired implement velocity and to affect a corresponding motion of the implement actuator. The range of the implement operator control device may be divided into a first portion and a second portion. The hydraulic implement system may also include a controller in communication with the boom operator control device, the boom actuator, the implement operator control device, and the implement actuator. The controller may be configured to selectively limit a velocity of the implement during manipulation of the implement operator control device within the first portion such that a lift velocity of the boom member of at least 65% of the desired operator boom member velocity is maintained.

In another aspect, the present disclosure is directed to a method of operating a machine. The method may include receiving a first input indicative of an operator desire to lift an implement, and receiving a second input indicative of an operator desire to simultaneously tilt the implement. The method may further include selectively limiting a tilt velocity of the implement during lifting of the implement based on the first and second inputs such that a lift velocity of at least 65% of an operator desired lift velocity is maintained when an operator desired tilt velocity is less than a threshold velocity.

DETAILED DESCRIPTION

Figure 1:
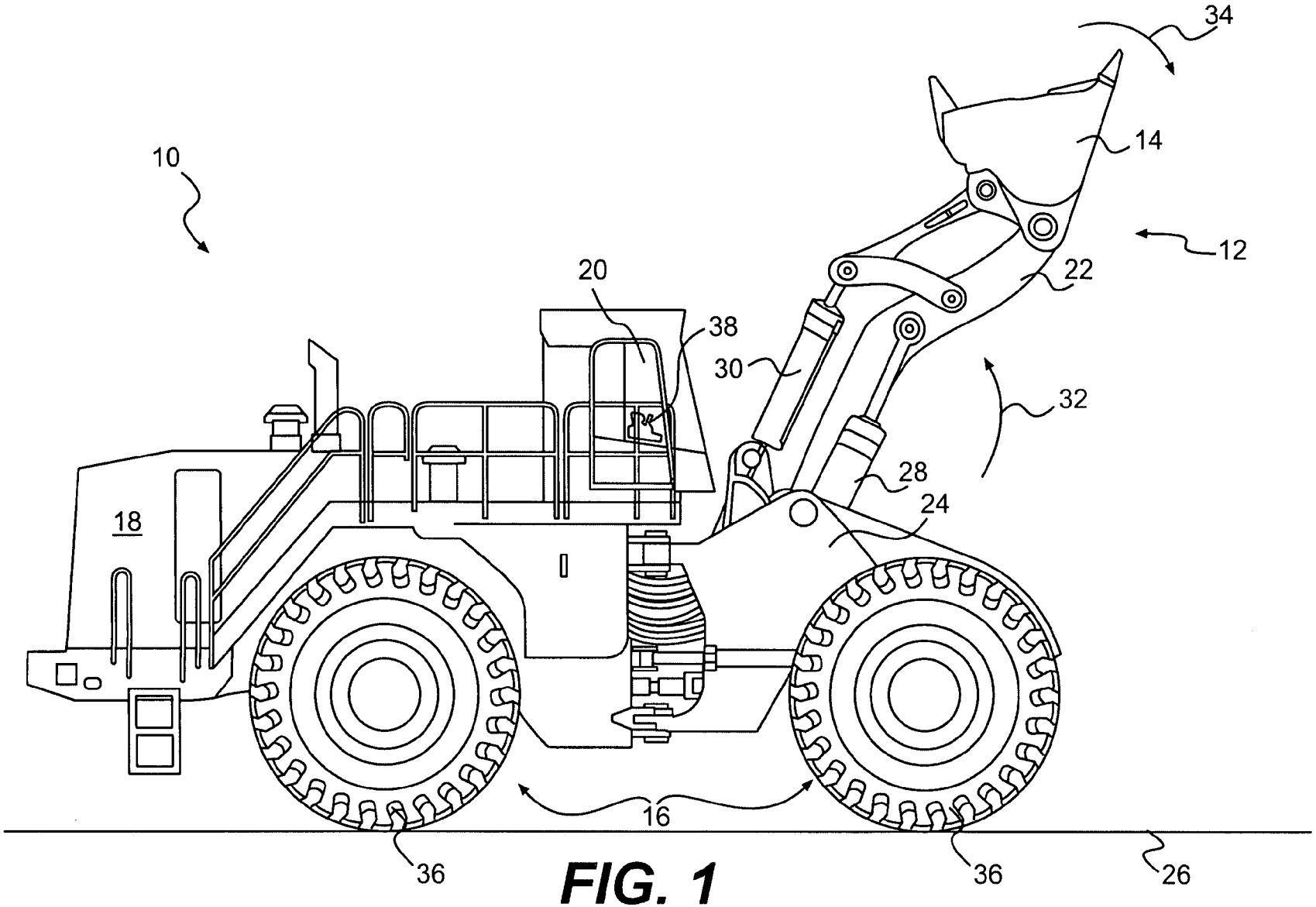
FIG. 1 is a side-view diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or any other industry known in the art. For example, machine 10 may be an earth moving machine such as a loader, an excavator, a dozer, or any other earth moving machine. Machine 10 may include an implement system 12 configured to move an implement 14, a drive system 16 for propelling machine 10, a power source 18 that provides power to implement system 12 and drive system 16, and an operator station 20 for operator control of implement and drive systems 12, 16.

Implement system 12 may include a linkage structure urged by fluid actuators to move implement 14. Specifically, implement system 12 may include a boom member 22 pivotally connected to a frame 24 of machine 10 and vertically movable relative to a work surface 26 by a pair of adjacent, double-acting, hydraulic cylinders 28 (only one shown in FIG. 1). Implement system 12 may also include a single, double-acting, hydraulic cylinder 30 operatively connected to vertically pivot implement 14 relative to boom member 22. It is contemplated that other linkage arrangements may be possible.

Each of hydraulic cylinders 28, 30 may include a tube and a piston assembly (not shown) arranged to form two separated pressure chambers. The pressure chambers may be selectively supplied with pressurized fluid and drained of the pressurized fluid to cause the piston assembly to displace within the tube, thereby changing the effective length of hydraulic cylinders 28, 30. The flow rate of fluid into and out of the pressure chambers may relate to a velocity of hydraulic cylinders 28, 30, while a pressure differential between the two pressure chambers may relate to a force imparted by hydraulic cylinders 28, 30 on the associated linkage members.

The expansion and retraction of hydraulic cylinders 28, 30 may function to assist in moving implement 14. In particular, as hydraulic cylinder 28 extends, boom member 22 may lift implement 14 away from surface 26 in the direction of an arrow 32. In contrast, as hydraulic cylinder 28 retracts, implement 14 may be lowered toward surface 26 in opposition to arrow 32. As hydraulic cylinder 30 extends, bucket 14 may be pivoted in the direction of arrow 34 (i.e., in a direction assisted by gravity) to dump its contents. In contrast, as hydraulic cylinder 30 retracts, implement 14 may be pivoted in opposition to an arrow 34 (i.e., in a direction resisted by gravity) to rack back to a carry position. It is contemplated that hydraulic cylinders 28, 30 may be connected to boom member 22 and implement 14 in a different manner such that the extension and retraction of hydraulic cylinders 28, 30 may result in movements other than those described above, if desired.

Numerous different implements 14 may be attachable to a single machine 10 and controllable via operator station 20. Implement 14 may include any device used to perform a particular task such as, for example, a bucket, a fork arrangement, a blade, a shovel, a ripper, or any other task-performing device known in the art. Although connected in the embodiment of FIG. 1 to pivot relative to machine 10, implement 14 may alternatively or additionally rotate, slide, swing, lift, or move in any other manner known in the art.

Drive system 16 may include one or more traction devices to propel machine 10. In one example, drive system 16 includes wheels 36 located on opposing side of machine 10. A rotational output from power source 18 may be transferred to drive wheels 36 via a transmission unit (not shown). It is contemplated that drive system 16 could alternatively include traction devices other than wheels such as tracks, belts, or other known traction devices.

Power source 18 may embody an engine such as, for example, a diesel engine, a gasoline engine, a gaseous fuel-powered engine, or any other type of combustion engine known in the art. It is contemplated that power source 18 may alternatively embody a non-combustion source of power such as a fuel cell, a power storage device, or another source known in the art. Power source 18 may produce a rotational output that may then be transferred to wheels 36 for propelling machine 10, and converted to fluid power for operating hydraulic cylinders 28, 30.

Operator station 20 may be configured to receive input from a machine operator indicative of a desired implement movement. Specifically, operator station 20 may include one or more operator control devices 38 embodied as single or multi-axis joysticks located proximal to an operator seat. Operator control devices 38 may be proportional-type controllers configured to position and/or orient implement 14 by producing an implement position signal (i.e., a boom position signal and a bucket position signal) that is indicative of a desired implement velocity. In one embodiment illustrated in FIG. 2, operator station 20 may include two operator control devices 38*a* and 38*b* associated with control of hydraulic cylinders 28, 30, respectively.

Operator control device 38*a* may be manipulated to indicate a desired movement of boom member 22. That is, operator control device 38*a* may be tiltable in a first direction about a generally horizontal axis through a displacement range from a neutral position to a maximum displaced position, and tiltable in a second direction opposite the first, from the neutral position to a maximum displaced position. It is contemplated that the maximum displaced positions in the first and second directions may be about equal in magnitude. The neutral position may relate to an operator's desire for no movement of boom member 22, while the maximum displaced positions may relate to an operator's desire for movement at a maximum velocity in a corresponding lifting or lowering direction. Operator control device 38*a* may be moved to any displaced position between the neutral position and the maximum displacement position to indicate a desire for a related velocity of boom member 22 in the corresponding direction (i.e., operator control device 38*a* may be moved to indicate a desire for a percent of the maximum possible boom member velocity, wherein the desired percent of the maximum boom member velocity may be about equal to the displacement percent of operator control device 38*a* between the neutral and maximum displaced positions).

Similarly, operator control device 38*b* may be manipulated to indicate a desired movement of implement 14 relative to boom member 22. That is, operator control device 38*b* may be tiltable in a first direction about a generally horizontal axis through a displacement range from a neutral position to a maximum displaced position, and tiltable in a second direction opposite the first, from the neutral position to a maximum displaced position. Like operator control device 38*a*, it is contemplated that the maximum displaced positions of operator control device 38*b* in the first and second directions may be about equal in magnitude to each other. The neutral position operator control device 38*a* may relate to an operator's desire for no movement of implement 14 relative to boom member 22, while the maximum displaced positions may relate to an operator's desire for movement at a maximum velocity in the corresponding dumping or racking directions. Operator control device 38*b* may be moved to any displaced position between the neutral position and the maximum displacement positions to indicate a desire for a related velocity of implement 14 in the corresponding direction.

In one embodiment, the range of motion of operator control device 38*b* may be divided into different portions. That is, the range from neutral to the maximum displaced position in the dumping direction of operator control device 38*b* may be divided into a first portion and a second portion. In one example, the first portion may correspond with about the first 60% of motion from the neutral position toward the maximum displaced position. In addition, the first portion may be further subdivided into a first sub-portion and a second sub-portion. In one example, the first sub-portion may include about the first 40% of motion from the neutral position toward the maximum displaced position, while the second sub-portion may include the range of motion from about 40% to about 60% of the range of motion. As will be described in further detail below, hydraulic actuator 30 may be controlled differently depending on the position of operator control device 38*b* relative to the first portion, the second portion, the first sub-portion, and the second sub-portion of its range of motion.

Figure 2:
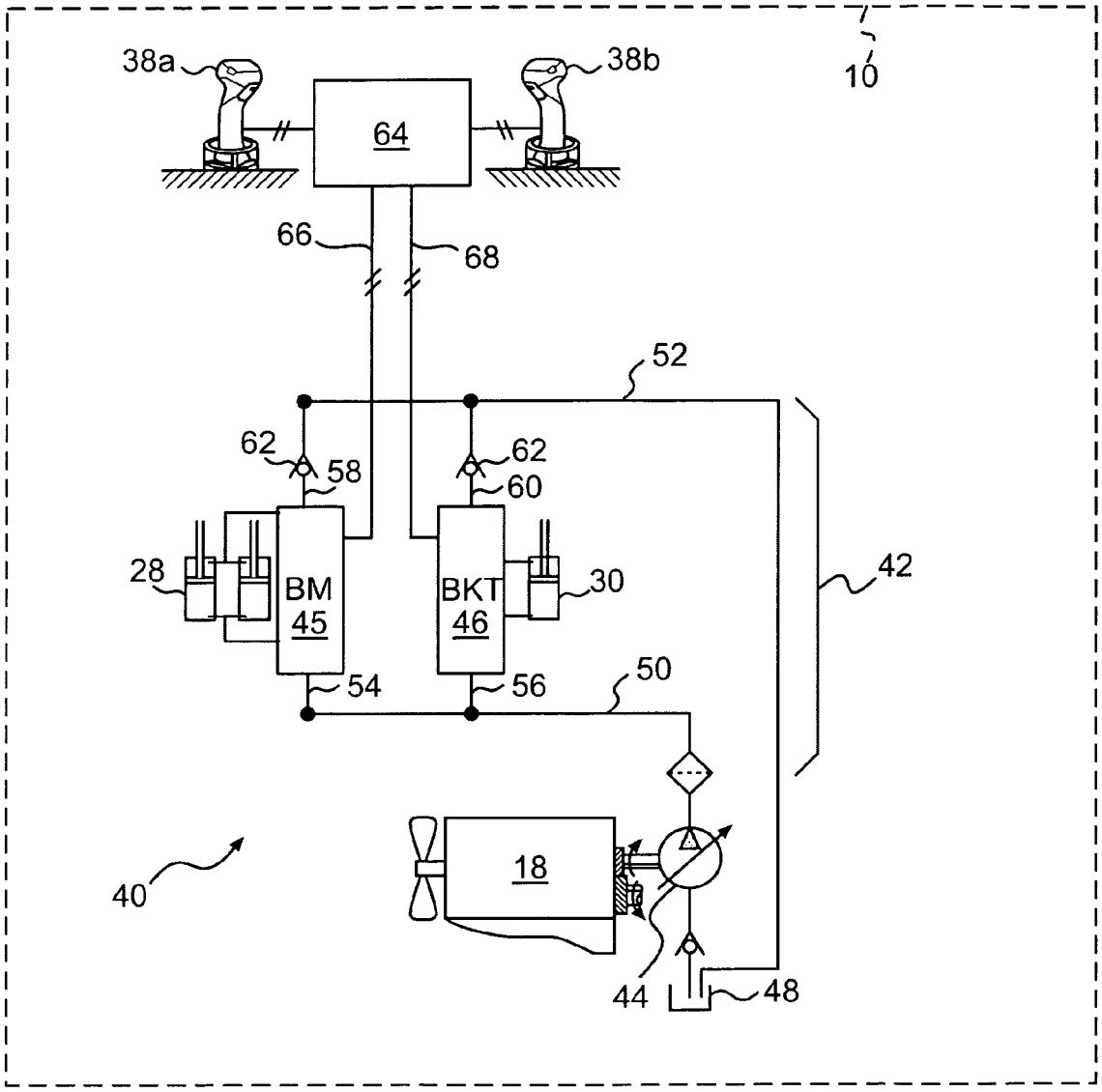
FIG. 2 is a schematic illustration of an exemplary disclosed hydraulic implement system that may be used with the machine of FIG. 1.

As also illustrated in FIG. 2, machine 10 may include implement control system 40 having a plurality of fluid components that cooperate to move implement 14 (referring to FIG. 1). In particular, implement control system 40 may include a circuit 42 configured to receive a flow of pressurized fluid from a source 44. Circuit 42 may include a boom control valve 45 and a bucket control valve 46 connected to receive the flow of pressurized fluid from source 44 in parallel. It is contemplated that additional control valve mechanisms may be included within circuits 42, if desired such as, for example, a swing control valve configured to control a swinging motion of implement system 12 relative to drive system 16, one or more attachment control valves, and other suitable control valve mechanisms.

Source 44 may be configured to draw fluid from one or more tanks 48 and pressurize the fluid to predetermined levels. Specifically, source 44 may embody a pumping mechanism such as, for example, a variable displacement, rotary piston-type pump drivably connected to power source 18 of machine 10 by, for example, a countershaft (not shown), a belt (not shown), an electrical circuit (not shown), or in any other suitable manner. Alternatively, source 44 may be indirectly connected to power source 18 via a torque converter, a reduction gear box, or in another suitable manner. The pressure and/or flow rate of the fluid flow produced by source 44 may be regulated based at least partially on the desired velocities of boom member 22 and implement 14. Alternatively or additionally, the pressure and/or flow rate may be based on a pressure or a pressure differential detected within circuit 42, if desired.

Tank 48 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 48. It is contemplated that implement control system 40 may be connected to multiple separate fluid tanks or to a single tank.

Each of boom and bucket control valves 45, 46 may regulate the motion of their related fluid actuators. Specifically, boom control valve 45 may have elements movable to control the motion of hydraulic cylinders 28 associated with boom member 22, while bucket control valve 46 may have elements movable to control the motion of hydraulic cylinder 30 associated with implement 14.

The control valves of circuit 42 may be connected to allow pressurized fluid to flow to and drain from their respective actuators via common passageways. Specifically, the control valves of circuit 42 may be connected to source 44 by way of a common supply passageway 50, and to tank 48 by way of a common drain passageway 52. Boom and bucket control valves 45, 46 may be connected in parallel to common supply passageway 50 by way of individual fluid passageways 54 and 56, respectively, and in parallel to common drain passageway 52 by way of individual fluid passageways 58 and 60, respectively. A check valve element 62 may be disposed within each of fluid passageways 58, 60 to provide for a unidirectional supply of pressurized fluid through the control valves.

Because the elements of boom and bucket control valves 45, 46 may be similar and function in a related manner, only the operation of boom control valve 45 will be discussed in this disclosure. In one example, boom control valve 45 may include a first chamber supply element (not shown), a first chamber drain element (not shown), a second chamber supply element (not shown), and a second chamber drain element (not shown). The first and second chamber supply elements may be connected in parallel with fluid passageway 50 to fill their respective chambers with pressurized fluid from source 44, while the first and second chamber drain elements may be connected in parallel with fluid passageway 52 to drain the respective chambers of fluid. To extend hydraulic cylinders 28, the first chamber supply element may be moved to allow the pressurized fluid from source 44 to fill the first chambers of hydraulic cylinders 28 with pressurized fluid via fluid passageway 54, while the second chamber drain element may be moved to drain fluid from the second chambers of hydraulic cylinders 28 to tank 48 via fluid passageway 58. To move hydraulic cylinders 28 in the opposite direction, the second chamber supply element may be moved to fill the second chambers of hydraulic cylinders 28 with pressurized fluid, while the first chamber drain element may be moved to drain fluid from the first chambers of hydraulic cylinders 28. It is contemplated that both the supply and drain functions may alternatively be performed by a single element associated with the first chamber and a single element associated with the second chamber, if desired.

The supply and drain elements of control valves 45, 46 may be solenoid movable against a spring bias in response to a command. In particular, hydraulic cylinders 28, 30 may move at a velocity that corresponds to the flow rate of fluid into and out of the first and second chambers. To achieve the operator-desired velocity indicated via the control device position signal, a command based on an assumed or measured pressure may be sent to the solenoids (not shown) of the supply and drain elements that causes them to open an amount corresponding to the necessary flow rate. The command may be in the form of a flow rate command or a valve element position or flow area command. It is contemplated that this same or a related command may be simultaneously send to source 44 to affect the output of source 44, if desired.

Implement control system 40 may also include a controller 64 in communication with operator control devices 38*a*, 38*b*, and with the supply and drain elements of control valves 45, 46. Specifically, controller 64 may be in communication with operator control device 38*a* by way of a communication line 66, with operator control device 38*b* by way of a communication line 68, and with the supply and drain elements of control valves 45, 46 via additional communication lines (not shown). It is contemplated that controller 64 may also be in communication with other components of implement control system 40, if desired, such as, source 44, a relief element (not shown), a bypass element (not shown), and other such components of implement control system 40.

Controller 64 may embody a single microprocessor or multiple microprocessors that include a means for controlling an operation of implement control system 40. Numerous commercially available microprocessors can be configured to perform the functions of controller 64. It should be appreciated that controller 64 could readily embody a general machine microprocessor capable of controlling numerous machine functions. Controller 64 may include a memory, a secondary storage device, a processor, and any other components for running an application. Various other circuits may be associated with controller 64 such as power supply circuitry, signal conditioning circuitry, solenoid driver circuitry, and other types of circuitry.

One or more maps relating the control device position signal, a desired velocity, associated flow rates, and/or valve element positions for hydraulic cylinders 28, 30 and control valves 45, 46 may be stored in the memory of controller 64. Each of these maps may include a collection of data in the form of tables, graphs, and/or equations. In one example, a desired implement velocity (i.e., tilt lever position) and commanded flow rate, velocity, or valve position may form the coordinate axis of a 2-D table for control of the first and second chamber supply elements of control valves 45, 46. Controller 64 may be configured to allow the operator to directly modify these maps and/or to select specific maps from available relationship maps stored in the memory of controller 64 to affect fluid actuator motion. It is contemplated that the maps may also be selectable based on modes of machine operation.

Figure 3:
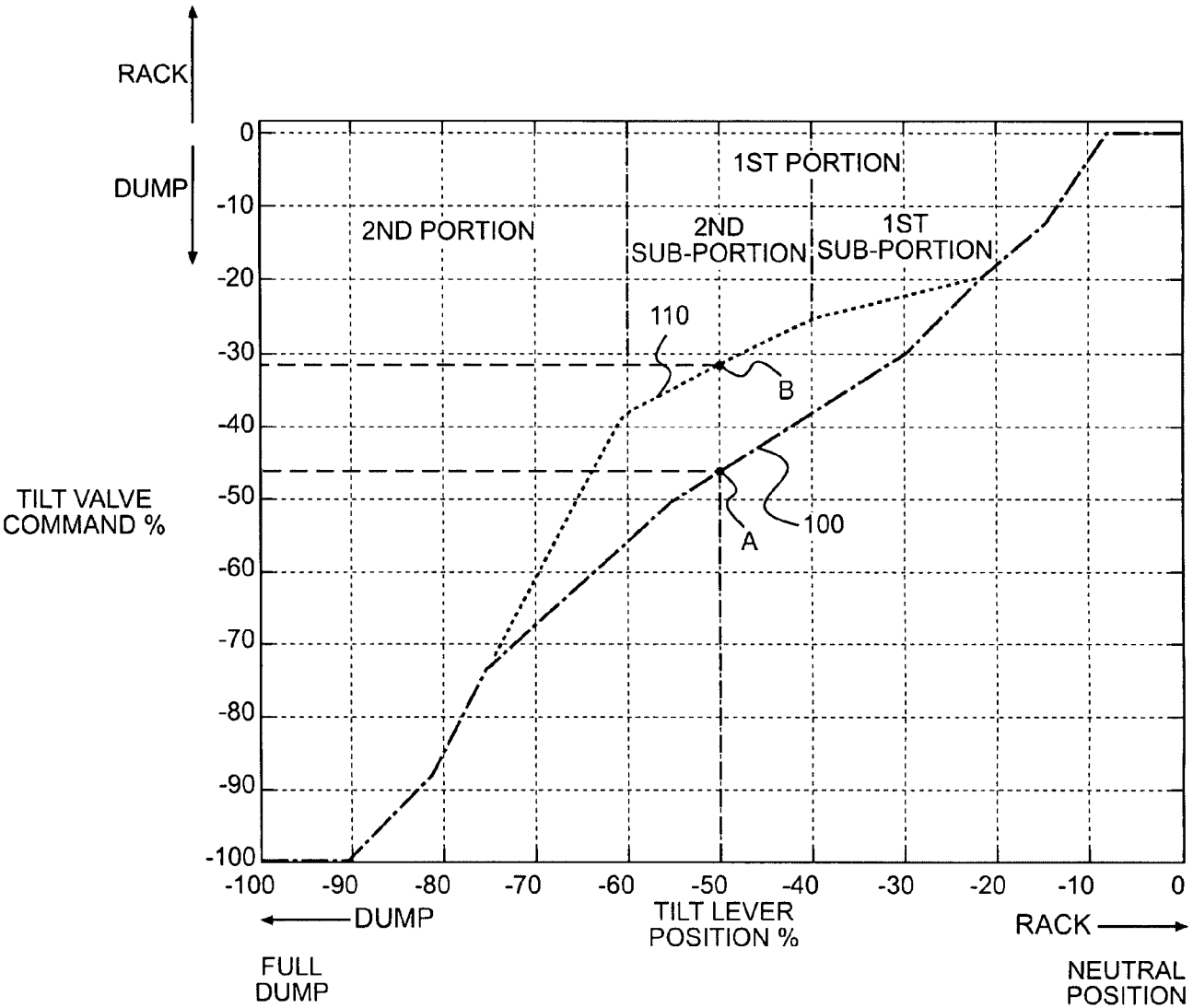
FIG. 3 is an exemplary electronic map usable by the hydraulic implement system of FIG. 2.

One exemplary relationship map is illustrated in FIG. 3. Within this map, the x-axis may be representative of a tilt position in percent of maximum displacement in a dumping direction of operator control device 38*b*. The x-value of 0 may correspond with operator control device 38*b* being in the neutral position, while the x-value of −100 may correspond with operator control device 38*b* being in the maximum position in the dump direction. The y-axis may be representative of a velocity command in percent of maximum velocity in the dump direction that is directed from controller 64 to control valve 46, the velocity command being used to regulate the velocity of hydraulic cylinder 30 in response to movement of operator control device 38*b*. The y-value of 0 may correspond with a neutral position of control valve 46, at which substantially all fluid flow through control valve 46 is blocked, while the y-value of −100 may correspond with a maximum displaced position of control valve 46 in the dump direction, at which a maximum fluid flow through control valve 46 is allowed. In this map, positive x- and y-values may correspond with movement in the rack direction.

The map of FIG. 3 contains multiple curves, each curve representing a different desired lift velocity of boom member 22 (i.e., a different displacement position of operator control device 38*a*). For example, a first curve 100 may be representative of the relationship between the position of operator control device 38*b* and a commanded velocity of hydraulic cylinder 30 when hydraulic cylinder 28 is stationary (i.e., when the desired lift velocity of boom member 22 is about 0%). A second curve 110 may be representative of the relationship between the position of operator control device 38*b* and a commanded velocity of hydraulic cylinder 30 when a desired or actual lift velocity of boom member 22 is about 60% of a maximum velocity. Additional curves (not shown) corresponding to other desired or actual velocities of boom member 22 may be included within the map of FIG. 3, if desired. A similar map relating a lift position of operator control device 38*a* to a lift velocity command sent to control valve 45 may similarly be stored in the memory of controller 64, if desired.

Controller 64 may be configured to receive input from operator control devices 38*a*, 38*b* and to command operation of control valves 45, 46 in response to the input and the relationship map(s) described above. Specifically, controller 64 may receive the control device position signals indicative of desired lift/lower and dump/rack velocities, and reference the relationship map(s) stored in the memory of controller 64 to determine flow rate values and/or associated positions for each of the supply and drain elements within control valves 45, 46. The flow rates or positions may then be commanded of the appropriate supply and drain elements to cause filling or draining of the first or second chambers at a rate that results in the operator desired implement velocity.

Figure 4:
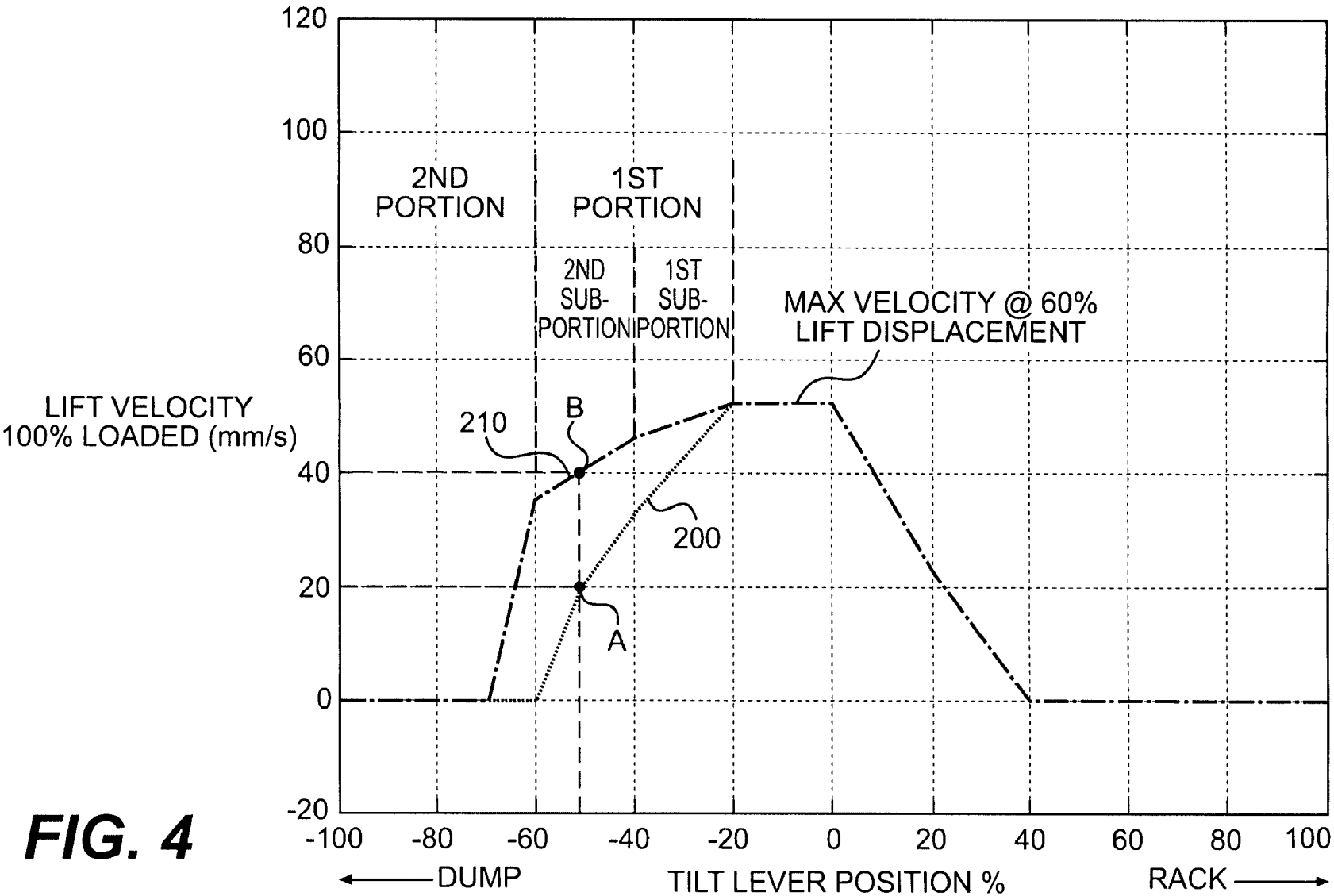
FIG. 4 is a chart illustrating an exemplary disclosed operational relationship associated with the machine of FIG. 1.

FIG. 4 illustrates an exemplary operation of implement control system 40. FIG. 4 will be discussed in the following section to further illustrate the disclosed system and its operation.

Industrial Applicability

The disclosed hydraulic implement system may be applicable to any machine that includes multiple fluid actuators where velocity predictability and priority control under varying loads is desired. The disclosed hydraulic implement system may improve velocity predictability and priority control by selectively limiting an amount of flow diverted from one actuator to another. By minimizing the amount of diverted flow, both actuators may perform in a predictable manner. The operation of implement control system 40 will now be explained.

During operation of machine 10, a machine operator may manipulate operator control devices 38*a* and 38*b* to indicate a desired to move implement 14. The actuation position of operator control device 38*a* (boom lift control) may be related to an operator expected or desired velocity of boom member 22, while the actuation position of operator control device 38*b* (bucket tilt control) may be related to an operator expected or desired velocity of implement 14 relative to boom member 22. Operator control devices 38*a*, 38*b* may generate position signals indicative of the operator expected or desired velocities during manipulation and send these position signals to controller 64.

As controller 64 receives the position signals from operator control devices 38*a*, 38*b*, controller 64 may reference the map(s) stored in memory to determine appropriate velocity or position commands directed to control valves 45, 46 that result in the desired velocities of hydraulic cylinders 28, 30 and, subsequently, boom member 22 and implement 14. For example, if operator control device 38*a* is, by itself (i.e., without simultaneous movement of operator control device 38*b*), manually moved to a displaced position in the lift direction about halfway between its neutral position and its maximum displaced position, controller 64 may reference a relationship map and command a corresponding movement of valve 45 that results in boom member 22 moving at about 50% of its maximum velocity. Similarly, if operator control device 38*b* is manually moved to a displaced position in the dump direction about half of the way between its neutral position and its maximum displaced position, controller 64 may reference curve 100 of the relationship map illustrated in FIG. 3, and command a corresponding movement of valve 46 that results in implement pivoting relative to boom member at about 47% of its maximum dump velocity (point A in the map of FIG. 3).

In some situations, known as cross-modulation situations, the output of source 44 may be insufficient to fully satisfy the velocities demanded of boom member 22 and implement 14. If unaccounted for, this insufficient supply could result in unexpected or no movement of boom member 22 and/or implement 14. That is, when the supply of pressurized fluid is insufficient to meet demands, a majority of the pressurized fluid will flow to the actuator having the least resistance, leaving the remaining actuators with less than required flow. In cross-modulation situations, for example, where boom member 22 is lifting against the force of gravity and implement 14 is dumping with the force of gravity, this path of least resistance may lead to hydraulic cylinder 30 and away from hydraulic cylinders 28. Thus, when attempting to lift and dump simultaneously, the lifting velocity of boom member 22 may be slower than expected because hydraulic cylinder 28 may receive a lower portion of the total output from source 44, as compared to that received by hydraulic actuator 30. This situation can be observed in the graph of FIG. 4. That is, when following a curve 200 corresponding to a lift velocity demand of about 60% (i.e., operator control device 38*a* has been tilted in the lift direction through about 60% of its range from its neutral position toward its maximum position), when operator control device 38*b* is moved from its neutral position to any displaced position less than about the 20% in the dump direction, the lift velocity of boom member 22 may be substantially unaffected by the dumping of implement 14. However, as operator control device 38*b* is displaced past 20% (i.e., a higher flow rate of fluid is requested for hydraulic cylinder 30), the lift velocity of boom member 22 drops dramatically until, at about 60% displacement of operator control device 38*b*, all of the flow from source 44 is consumed by hydraulic actuator 30 and boom member 22 has completely stopped moving.

To account for the insufficient output of source 44 during cross-modulation situations, controller 64 may selectively limit the flow of pressurized fluid directed to hydraulic actuator 30. Specifically, when boom member 22 is being lifted by hydraulic cylinders 28 and an input is received from operator control device 38*b* indicative of a desire to simultaneously dump implement 14, controller 64 may reference the desired velocity of boom member 22 (i.e., the position of operator control device 38*a*) and the desired velocity of implement 14 (i.e., the position of operator control device 38*b*) with the map of FIG. 3 to determine an adjusted velocity command directed to control valve 46. The adjusted velocity command may correspond with curve 110 in the map of FIG. 3. For example, if boom member 22 has been commanded a lift velocity of about 60% of its maximum velocity, and an input indicative of a desired dump velocity of 50% is simultaneously received, instead of utilizing curve 100, controller 64 may reference curve 110 to determine an adjusted dump velocity command of about 30% (point B in the map of FIG. 3). As can be seen from the map of FIG. 3 (i.e., the vertical difference between points A and B), curve 110 may relate a lower commanded tilt velocity to a given position of operator control device 38*b*, as compared to curve 100. As a result, a lower flow of pressurized fluid may be allowed through control valve 46 to hydraulic cylinder 30 when a lifting movement of boom member 22 has been simultaneously requested or commanded. By lowering the flow of pressurized fluid through control valve 46 to hydraulic cylinder 30, more of the output from source 44 may be available for lifting boom member 22.

As can be seen from a curve 210 in the graph of FIG. 4, utilization of adjusted curve 110 from the map of FIG. 3 may result in an increased lift velocity of boom member 22 and simultaneous lifting movement of boom member 22 for a greater displacement range of operator control device 38*b*. For example, by decreasing the dump velocity command directed to control valve 46 when operator control device 38*b* is displaced to about the 50% of its maximum displacement from about 47% (point A) to about 30% (point B) of its maximum velocity, the lift velocity of boom member 22 may be increased from about 20 mm/s to about 40 mm/s (i.e., from about 35% of a requested velocity to about 70% of the requested velocity). And, by adjusting (i.e., reducing) the commanded tilt velocity relative the desired tilt velocity for operator control device displacements of up to about 75% of the range of device 38*b*, boom member 22 may be simultaneously operated for a greater amount of time (compare horizontal distance between curves 200 and 210 at 60% tilt lever in the graph of FIG. 4).

When operating in a cross-modulation situations and operator control device 38*b* is modulated within its first portion, controller 64 may limit the dump velocity of implement 14 such that at least about 65% of a demanded lift velocity of boom member 22 may always be maintained. The 65% dump velocity may be maintained regardless of implement loading. Further, when operator control device 38*b* is modulated within only the first sub-portion, a boom lift velocity of at least 85% of desired velocity may always be maintained by adjusting (i.e., reducing) the commanded dump velocity of implement 14. In addition, while adjusting dump velocity to improve lift velocity, controller 64 may ensure dump velocity is never adjusted to below about 60% of the demanded dump velocity.

There may be situations during cross-modulation, when dump velocity becomes more important than lift velocity. During these situations, adjustment of the desired dump velocity of implement 14 may be minimal or non-existent. These situations may correspond with the second portion of the motion range of operator control device 38*b*. That is, if operator control device 38*b* is moved past about 60% of its range from the neutral position toward the maximum displaced position, controller 64 may reduce the adjustment of the velocity command relative to the displacement position of operator control device 38*b*. And, after displacement of operator control device 38*b* exceeds about 75% of its range, the command may no longer be adjusted at all. In these situations, the output from source 44 may be insufficient to simultaneously lift and dump as desired and, as illustrated by curve 210 in the graph of FIG. 4, boom member 22 may slow or even stop moving. When operator control device 38*b* has been displaced to less than about 20% of its range, the command may also not be adjusted, as the supply of fluid from source 44 may be sufficient to meet demands.

As can be seen in the map of FIG. 3 and the operational graph of FIG. 4, the relationships between operator control device displacement, commanded velocities, and resulting velocities may be substantially linear. Specifically, as can be seen in the map of FIG. 3, the relationship between the displacement position of operator control device 38*b* and the adjusted command velocity (i.e., slope of curve 110) within the first sub-portion of its displacement range may be substantially linear. Similarly, this same relationship within the second sub-portion and within the second portion may be substantially linear. However, the slope of curve 110 may different between the first sub-portion, the second sub-portion, and the second portion. The slope of curve 110 may be different based on efficiency changes of source 44 at the differing output flow rates and desired responsiveness of machine 10. Likewise, the relationship between displacement position of operator control device 38*b* and the resulting lift speed of boom member 22 may be substantially linear within each of the first sub-portion, second sub-portion, and second portion.

Several advantages may be associated with the strategy and hardware of implement control system 40. Specifically, implement control system 40 may be applicable to large machines having high flow requirements and high lift capacities. And, because the disclosed hydraulic implement control system may utilize a single variable displacement, rotary piston-type pump to supply all fluid flow, the system may be simple, inexpensive, and adaptable to varying loading demands.

It will be apparent to those skilled in the art that various modifications and variations can be made to the disclosed hydraulic implement system. Other embodiments will be apparent to those skilled in the art from consideration of the specification and practice of the disclosed hydraulic implement system. It is intended that the specification and examples be considered as exemplary only, with a true scope being indicated by the following claims and their equivalents.

What is claimed is:

1. A hydraulic implement system, comprising:

a boom member;

a boom actuator situated to move the boom member;

a boom operator control device movable through a range to indicate a related operator desired boom member velocity and to affect a corresponding motion of the boom actuator;

an implement pivotally connected to the boom member;

an implement actuator situated to move the implement relative to the boom member;

an implement operator control device movable through a range to indicate a related operator desired implement velocity and to affect a corresponding motion of the implement actuator, the range of the implement operator control device being divided into a first portion and a second portion;

a single common pump configured to supply pressurized fluid to both the boom actuator and the implement actuator; and a controller in communication with the boom operator control device, the boom actuator, the implement operator control device, and the implement actuator, the controller being configured to determine that an amount of fluid required to satisfy both the operator desired implement velocity and the operator desired boom member velocity exceeds a capacity of the single common pump, and to selectively limit a velocity of the implement in response to the determination during manipulation of the implement operator control device within the first portion such that a lift velocity of the boom member of at least 65% of the operator desired boom member velocity is maintained.

2. The hydraulic implement system of claim 1, wherein the implement is movable in a gravity assisted direction and a gravity resisted direction, and a velocity of the implement in only the gravity assisted direction is limited by the controller.

3. The hydraulic implement system of claim 1, wherein the first portion is about 60% of the range of the implement operator control device from a neutral position to a maximum position.

4. The hydraulic implement system of claim 3, wherein the velocity of the implement is not limited when the implement operator control device is displaced past about 75% of its range from the neutral position toward the maximum position.

5. The hydraulic implement system of claim 4, wherein the velocity of the implement is not limited when the implement operator control device is displaced to less than about 20% of its range from the neutral position toward the maximum position.

6. The hydraulic implement system of claim 2, wherein:

the first portion includes a first sub-portion and a second sub-portion; and the controller is configured to selectively limit the velocity of the implement during manipulation of the implement operator control device within the first sub-portion such that a lift velocity of the boom member of at least 85% of the operator desired boom member velocity is maintained.

7. The hydraulic implement system of claim 6, wherein the first sub-portion is about 40% of the range of the implement operator control device from a neutral position toward a maximum position.

8. The hydraulic implement system of claim 7, wherein a rate of velocity limiting within the second portion, the first sub-portion, and the second sub-portion is substantially linear.

9. The hydraulic implement system of claim 8, wherein the rate of velocity limiting is different between the second portion, the first sub-portion, and the second sub-portion.

10. The hydraulic implement system of claim 1, wherein the velocity of the implement is only limited when the boom member is moved simultaneous with the implement.

11. The hydraulic implement system of claim 1, wherein the single common pump is a variable displacement piston type pump.

12. A method of operating a machine, comprising:

receiving a first input indicative of an operator desire to lift an implement;

receiving a second input indicative of an operator desire to simultaneously tilt the implement;

supplying pressurized fluid in response to at least one of the first and second inputs with a single common pump;

determining that a capacity of the single common pump is insufficient to satisfy the operator desire to simultaneously lift and tilt the implement; and selectively limiting a tilt velocity of the implement in response to the determination during lifting of the implement based on the first and second inputs such that a lift velocity of at least 65% of an indicated desired lift velocity is maintained when an indicated desired tilt velocity is less than a threshold velocity.

13. The method of claim 12, wherein only a tilt velocity of the implement in a gravity assisted direction is limited.

14. The method of claim 12, wherein the threshold velocity is about 60% of a maximum velocity.

15. The method of claim 14, wherein the tilt velocity is not limited when the indicated desired tilt velocity exceeds about 75% of the maximum velocity.

16. The method of claim 15, wherein the tilt velocity is not limited when the indicated desired lift velocity is less than about 20% of the maximum.

17. The method of claim 12, wherein a rate of tilt velocity limiting is substantially linear.

18. The method of claim 12, further including:

pressurizing fluid at a rate corresponding to the lift velocity and to the tilt velocity of the implement; and directing the pressurized fluid to affect lifting and tilting of the implement in response to the first input, the second input, and the tilt velocity limiting.

19. A machine, comprising:

a frame;

a boom member pivotally connected to the frame;

a boom actuator configured to affect movement of the boom member relative to the frame;

a boom operator control device movable through a range to indicate a related operator desired boom member velocity and to affect a corresponding motion of the boom actuator;

an implement pivotally connected to the boom member;

an implement actuator situated to move the implement relative to the boom member;

an implement operator control device movable through a range to indicate a related operator desired implement velocity and to affect a corresponding motion of the implement actuator, the range of the implement operator control device being divided into a first portion and a second portion;

a single common variable displacement pump driven to supply pressurized fluid to the boom actuator and to the implement actuator in response to the first and second input; and a controller in communication with the boom operator control device, the boom actuator, the implement operator control device, and the implement actuator, the controller being configured to determine that an amount of fluid required to satisfy both the operator desired implement velocity and the operator desired boom member velocity exceeds a capacity of the single common pump, and to selectively limit a velocity of the implement in a gravity assisted direction in response to the determination during manipulation of the implement operator control device within the first portion such that a lift velocity of the boom member of at least 65% of the operator desired boom member velocity is maintained.

* * * * *